United States Patent [19]

Brock et al.

[11] Patent Number: 4,812,172

[45] Date of Patent: Mar. 14, 1989

[54] ROTARY APPARATUS AND METHOD FOR REMOVING TRIM RINGS FROM COMPOSITE CANS

[75] Inventors: James E. Brock; William R. DeUnger, both of Orlando, Fla.

[73] Assignee: Citrus Central, Inc., Orlando, Fla.

[21] Appl. No.: 117,339

[22] Filed: Nov. 6, 1987

[51] Int. Cl.[4] ..... B08B 9/04

[52] U.S. Cl. ..... 134/22.1; 15/70; 15/213; 15/104.16; 134/24; 134/25.4; 134/25.3

[58] Field of Search ..... 134/22.1, 24, 25.4, 134/25.3; 15/213, 70, 104.16

[56] References Cited

U.S. PATENT DOCUMENTS

| | | | |
|---|---|---|---|
| 4,269,264 | 5/1981 | Goeldner | 134/8 |
| 4,705,575 | 11/1987 | Koch | 134/24 |
| 4,716,611 | 1/1988 | Barry | 134/8 |

*Primary Examiner*—Asok Pal

*Attorney, Agent, or Firm*—Duckworth, Allen, Dyer & Doppelt

[57] ABSTRACT

Rotary apparatus and a related method for removing foreign and undesirable material from composite cans during the manufacturing operation includes a pair of rotatable plates having an axis of rotation and outwardly-extending fingers faced about the periphery thereof, and a plurality of reciprocating plungers arranged alongside the periphery of the plates and generally parallel with the axis of rotation, the plungers being rotated with the plates about a common drive shaft. The rearward end of each plunger engages a cam race for extending the plungers into and out of composite cans positioned about the periphery of the plate only during a portion of each revolution of rotation of the plate, in order to remove trim ring scrap and other foreign objects from the cans.

14 Claims, 2 Drawing Sheets

10
58
46
44
48
56
46
48
48
46
45
45
55
53
55
26
46
24
48
12
48
46
64
20
16
14
18

ROTARY APPARATUS AND METHOD FOR REMOVING TRIM RINGS FROM COMPOSITE CANS

BACKGROUND OF THE INVENTION

1. Field of the Invention

The present invention relates to apparatus and methods useful in the spiral winding and cutting of paper tubes to form composite cans, and in particular, relates to apparatus and methods useful for removing foreign and undesirable materials from the can after the winding and cutting operations.

2. Description of the Prior Art

Numerous prior art patents suggest apparatus and methods for winding a strip of heavy paper into a tube around a mandrel winding and glueing a labeling strip onto the tube, and then cutting the tube into specified lengths. See, for example, U.S. Pat. Nos. 3,133,482 to Glassey and 2,712,778 to Robinson.

After the tube is cut into the prescribed length, each length is provided with a bottom, the container is filled with a consumable product (such as concentrated citrus juice, for example) and a removable top is affixed to the open end. This type of container is commonly referred to as a "composite can".

Many millions of such composite cans are required to satisfy the demands of the marketplace. Therefore, the manufacture of these cans must necessarily be accomplished at high production rates. Thus, a typical composite can tube winding machine will manufacture on the order of about one hundred and fifty thousand cans per shift.

As described in the above-mentioned patents, it is necessary to provide some means of indexing the cutting operation, in order to insure that each can is cut to the same prescribed length. Some commercially available composite can tube winding machines accomplish this by providing a so-called "trim ring" cutting operation wherein some cans are trimmed at one end to insure that all of the cans are of the same length. The result of this operation is a narrow trim ring of scrap material.

In order to prevent this trim ring scrap from remaining with, or in one of the cans, it is customary to force a high-velocity stream of air across the can following the trimming operation. Nevertheless, an occasional trim ring becomes lodged in the can, and remains there during the closure and sealing operations, to be discovered by the consumer when the can is opened. While the number of such defects is extremely small, on the order of less than 00.2% of manufactured composite cans, the inevitable expressions of comsumer concern and concomitant loss of product goodwill represents a substantial economic loss.

There are several prior art patents which suggest techniques for cleaning foreign and undesirable materials from containers during the manufacturing operation.

In U.S. Pat. No. 1,173,255, Eberhart discloses apparatus employing brushes which are moved into the cans in synchronous fashion.

U.S. Pat. No. 2,262,697 to Pearson discloses a metal can cleaning mechanism for removing solder in which the cleaning mechanism is aligned with the can and then rotated through the can for cleaning the internal surface.

Other prior art of interest include: U.S. Pat. Nos. 3,490,404 (Vanderlaan et al); 2,327,986 (Bach); 3,881,436 (Paumier et al); 3,983,729 (Traczyk et al); and 2,295,595 (Gladfelter).

In our prior U.S. Pat. No. 4,185,348, we disclose an apparatus and related method for removing trim rings from composite cans, which apparatus employs two conveyors, across one of which the composite cans are conveyed and with a series of reciprocating plungers engaged within a cam race and mounted on the second conveyor alongside the first conveyor, so as to extend into and out of the composite cans for removing trim rings and other foreign material from the cans.

SUMMARY OF THE INVENTION

This invention is an improvement over the trim ring removal apparatus and method described in our earlier U.S. Pat. No. 4,185,348. This invention is directed to a rotary apparatus and method requiring much less maintenance, which is not susceptible to misalignments causd by "chain stretch", and which is much more easily adapted to composite cans of different sizes.

In one form, the apparatus of the present invention incorporates a rotatable drum comprising at least one (and preferably two) flat, generally circular plate having an axis of rotation. Means are provided for feeding open ended tubes, such as composite cans, across the periphery of the plate during rotation, with the axis of each tube generally parallel to the axis of rotation of the plate. Means are also provided for indexing the tubes in spaced relation about the periphery of the drum, and for holding the tubes against the periphery of the drum during at least a portion of each revolution of rotation of the plate.

In order to remove foreign and undesirable materials (such as trim rings) while the tubes are passing "on the fly", a plurality of reciprocating plungers are arranged alongside the periphery of the plate and generally parallel with the axis of rotation. Means are provided for extending each plunger into a corresponding tube while positioned on the periphery of the plate and during the portion of each revolution of rotation, for removing any such foreign objects located in the tube.

In a preferred embodiment, the extending means comprises a circuitous cam race spaced from, and generally in the plane of the periphery of the plate, the cam race engaging the rearward end of each plunger and camming the plunger toward and through a corresponding one of the tubes preferably only during the portion of each revolution of rotation of the plate.

In the preferred embodiment of the present invention, the plurality of plungers are collectively supported on a carousel which is rotated on the same drive shaft as the drum and plate supporting the tubes to be treated.

THE DRAWING

FIGS. 1, 2 and 3 are left side, rear and right side elevations of the apparatus in accordance with the present invention, with a portion of the apparatus removed in each view in order to more clearly illustrate the apparatus.

DESCRIPTION OF THE PREFERRED EMBODIMENT

Figure 1:
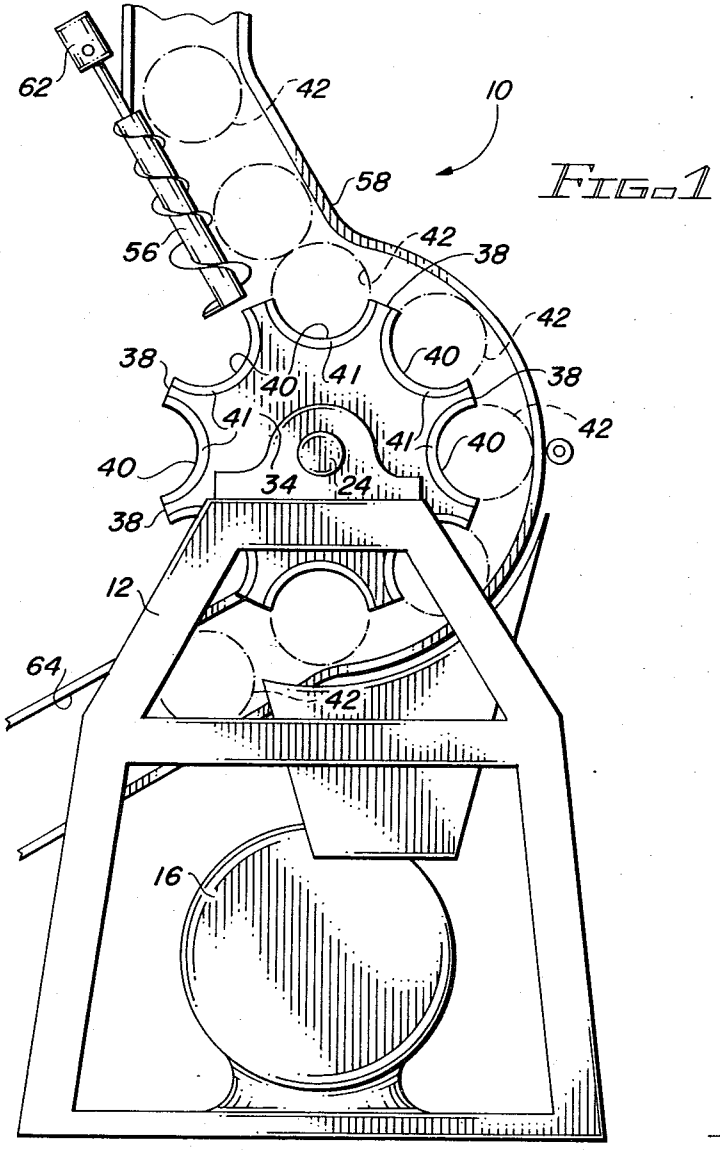

The preferred embodiment of the present invention will now be described with reference to FIGS. 1, 2, and 3. The composite cam cleaning apparatus in accordance with the present invention is referred to generally by the reference numeral 10 in each of FIGS. 1, 2 and 3. The apparatus 10 includes a support frame including an upper frame 12 supporting various machine elements described in greater detail below, and a lower frame portion 14 supporting a drive motor 16 having a drive shaft 18 and to which is affixed a drive wheel 20. A drive belt 22 engages the drive wheel 20, and an upper drive wheel 30, for rotating a drive shaft 24.

The drive shaft 24 is rotatably positioned between bearings 26 and 28 on opposite sides of the upper frame portion 12. A rotatable drum 32 is rotatably mounted on the drive shaft 24, and comprises two flat, generally circular plates 34 and 36, each plate having outwardly-extending fingers 38 (FIG. 1) spaced about the outer periphery of each of the plates 34, 36. The space between each outwardly-extending finger 38 is scalloped with curved, semi-circular indentations, or pockets 40 dimensioned to receive a tube, such as the composite cans 42 shown by imaginary lines in FIG. 1, within each indentation. A pocket liner 41 fits within each indentation 40, and facilitates the changing of the machine 10 for cans of different diameters.

Figure 2:
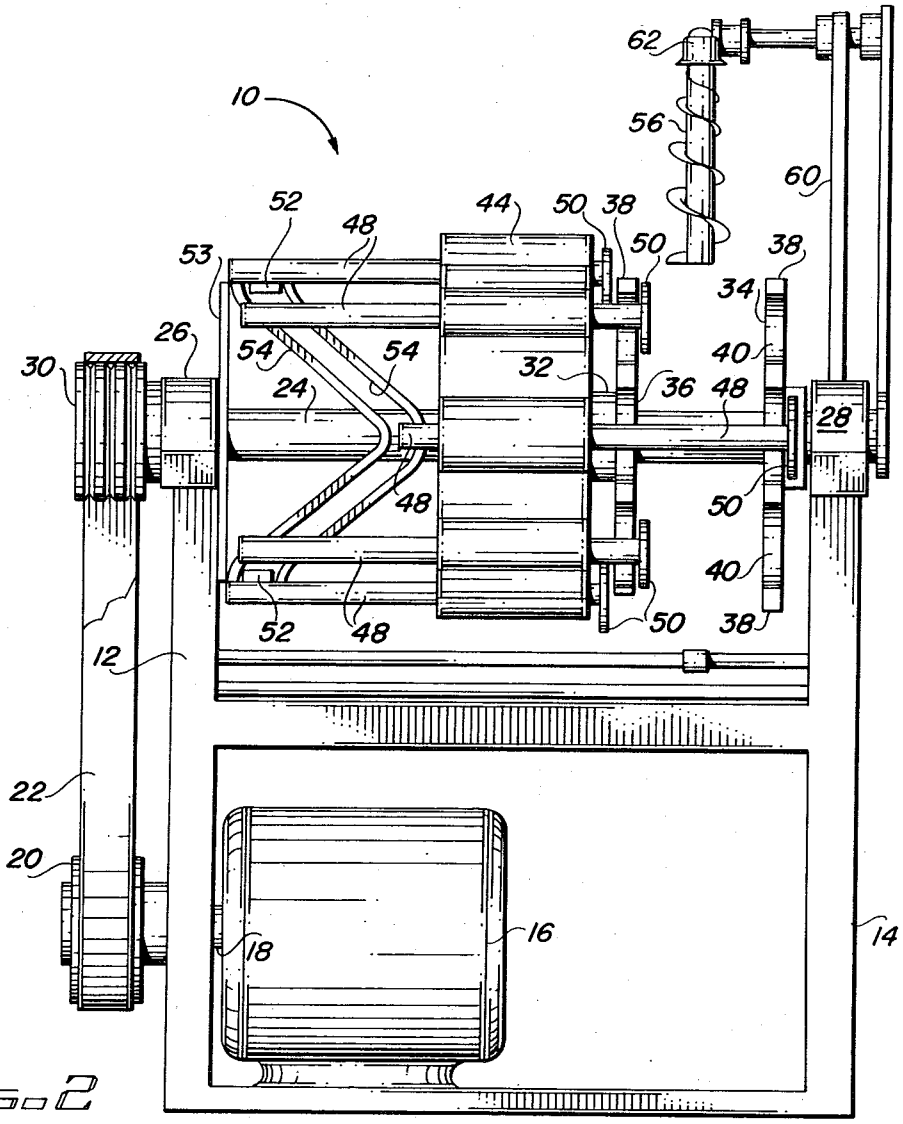
Figure 3:
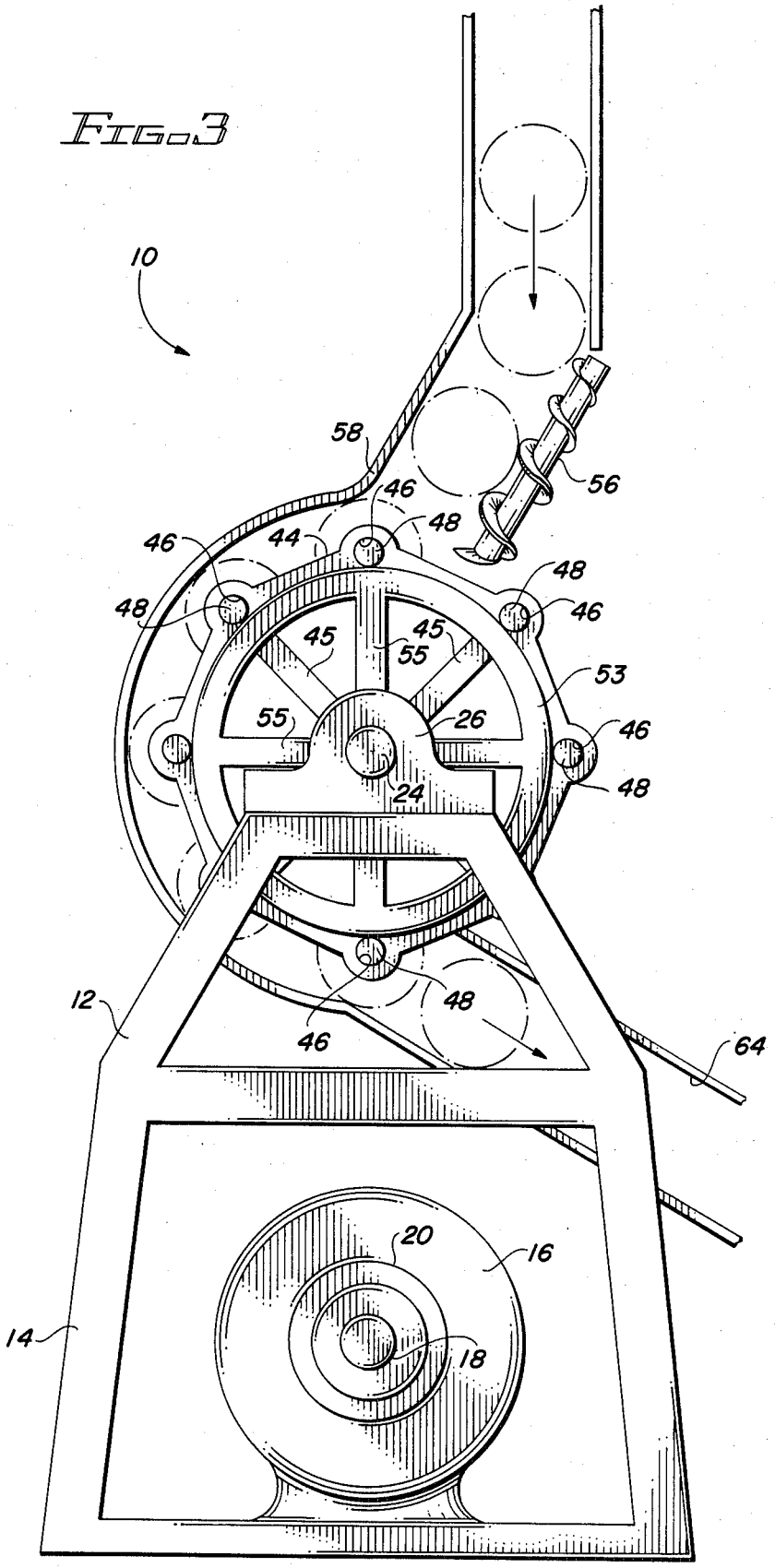

Referring now to FIGS. 2 and 3, the apparatus 10 includes a cylindrical carousel 44 rotatably mounted by spokes 45 to the drive shaft 24. The carousel 44 includes plural passageways 46 extending generally parallel with the axis of rotation of the drive shaft 24, each passageway 46 slideably engaging a plunger 48. While the number of plungers 48 is not critical, it will be understood from the configuration of FIGS. 1–3 that each plunger is positioned and dimensioned so as to extend over and across a corresponding scalloped indentation 40 on the plates 34 and 36, and thus through a composite can 42 resting in the corresponding indentation 40. Each plunger 48 has a pliable cleaning head 50 mounted at the forward end thereof, and a cam bearing 52 extending laterally from its rearward end, in order to permit each plunger to be sequentially and reciprocally cammed toward and away from the plates 34 and 36, as is more fully described below. Each cleaning head 50 has a diameter corresponding to the cans 42, and are removable to adjust for cans of different diameters.

A curved, circuitous cam race 54 is fixed between the carousel 44 and the bearing 26 with a ring 53 and supporting struts 55. As will be understood, the cam race 54 is immobile with respect to the rotation of the drive shaft 24. The dimensions between the two rails of the cam race 54 are such that each cam bearing 52 on the rearward end of each plunger 48 fits into the cam race 54 as the carousel 44 rotates. As shown in FIG. 2, a portion of the cam race 54 curves inwardly toward the carousel 44, in order to cam each plunger 48 through a corresponding can 42.

The apparatus 10 further includes an auger feed 56, which is driven via a belt 60 and gear box 62 from the drive shaft 24 so as to feed the composite cans 42 across the indented periphery of the plates 34 and 36 during rotation of those plates, with the axis of each of the composite cans being generally parallel to the axis of rotation of the drive shaft 24. A fixed backing sheet 58 holds the composite cans 42 against the indented periphery of the plates 34 and 36 during that portion of each revolution of rotation of those plates in which the plungers 48 extend into the can 42. An output chute 64 is positioned so as to receive the composite cans 42 as they are gravity fed off of the indented periphery of the plates 34, 36. A "catch" container 66 receives the trim rings and other foreign objects pushed from the composite cans 42 caused by the reciprocal operation of the plungers 48, as the plungers are cammed through a corresponding one of the composite cans during rotation of the carousel 44 and engagement with the cam race 54.

While the apparatus and method described in our earlier U.S. Pat. No. 4,185,348 satisfactorily removes foreign objects and trim rings from composite cans, that construction was susceptible to "chain stretch", and requires some down time for changing configurations for different sizes of cans. The apparatus and method disclosed above and illustrated in FIGS. 1–3 avoids these difficulties.

What is claimed is:

1. Apparatus for removing foreign and undesirable materials from a plurality of open-ended lengths of hollow tubing, said apparatus comprising:

a rotatable drum having an axis of rotation;

means for rotating said drum;

means for feeding tubes across the periphery of said drum during rotation, with the axis of each tube generally parallel to the axis of rotation;

means for indexing said tubes in spaced relation about the periphery of said drum;

means for holding said tubes against the periphery of drum during a portion of each revolution of rotation of said drum; and means extending into each tube while positioned on the periphery of said drum and during rotation for removing any foreign objects located in any tube, said removing means including a plurality of reciprocating plungers arranged alongside the periphery of said drum and generally parallel with said axis of rotation, and means for extending each of said plungers across the periphery of said drum and through one of said tubes, to remove any foreign objects therein.

2. The apparatus recited in claim 1 wherein said extending means comprises camming means engaging all of said plungers.

3. The apparatus recited in claim 2 wherein said camming means extends said plungers into the corresponding one of said tubes only during said portion of each revolution of rotation of said drum.

4. The apparatus recited in claim 2 wherein said camming means comprises a circuitous cam race spaced from and generally in the plane of the periphery of said drum.

5. The apparatus recited in claim 4 further comprising means for rotating said plungers with said drum from a common drive shaft.

6. The apparatus recited in claim 1 wherein said indexing means comprises plural fingers extending from the periphery of said drum.

7. The apparatus recited in claim 6 wherein said holding means comprises a fixed curved sheet extending about said portion of said drum.

8. The apparatus recited in claim 1 wherein said drum comprises two generally circular plates spaced apart a dimension less than the length of said tubes, each plate havng a scalloped periphery forming outwardly-extending integral fingers and curved semi-cirular indentations dimensioned to receive one of said tubes in each indentation.

9. Apparatus for removing foreign and undesirable materials from a plurality of open-ended lengths of hollow-tubing, said apparatus comprising:

a rotatable plate having an axis of rotation and having outwardly-extending fingers faced about the periphery thereof;

means for feeding and holding tubes across the periphery of said plate between said fingers and generally parallel with axis of rotation of said plate during a portion of each revolution of rotation of said plates;

a plurality of reciprocating plungers arranged alongside the periphery of said plate and generally parallel with the axis of rotation of said plate;

means for extending said plungers into and out of said tubes only during said portion of each revolution of rotation; and means for rotating said plate and said plungers about said axis of rotation from a common drive shaft.

10. The appartus recited in claim 9 wherein said plunger extending means comprises a cylindrical carousel coaxial with said rotatable plate, and with said plungers mounted about the periphery of said carousel.

11. The apparatus recited in claim 10 further comprising a fixed sheet spaced from, and curved around a portion of the periphery of said plate for holding said tubes against the periphery of said plate during said portion of each revolution of rotation.

12. The apparatus recited in claim 11 wherein said indexing means comprises semi-circular indentations spaced about the periphery of said plate, each indentation dimensioned to receive one of said tubes therein.

13. The apparatus recited in claim 12 wherein each plunger includes a pliable cleaning head at a forward extremity thereof, and wherein said plate and said carousel are positioned such that each cleaning head of each plunger passes through a tube held in a corresponding semi-circular indentation during reciprocal motion of each plunger toward and away from said plate.

14. A method for removing foreign and undesirable materials from a plurality of open-end lengths of hollow tubing, said method comprising the steps of:

providing a plate having an axis of rotation and spaced indentations about its periphery with each indentation dimensioned to receive one of said open-ended tubes;

rotating said plate about said axis of rotation from a drive shaft;

feeding tubes into said indentations;

providing plural plungers;

mounting said plungers in a carousel on said drive shaft; and rotating said carousel from said drive shaft and sequentially reciprocating said plungers into and out of each tube during a rotation, in order to remove foreign and undesirable materials therein.

* * * * *